US005456609A

United States Patent [19]

Imanishi

[11] Patent Number: 5,456,609

[45] Date of Patent: Oct. 10, 1995

[54] PLUG CAP DEVICE FOR INTERNAL COMBUSTION ENGINE

[75] Inventor: Hisao Imanishi, Yokkaichi, Japan

[73] Assignee: Sumitomo Wiring Systems, Ltd., Japan

[21] Appl. No.: 208,609

[22] Filed: Mar. 9, 1994

[30] Foreign Application Priority Data

Mar. 12, 1993 [JP] Japan ..... 5-079154

[51] Int. Cl.[6] ..... H01R 11/11

[52] U.S. Cl. ..... 439/125

[58] Field of Search ..... 439/125–128

[56] References Cited

U.S. PATENT DOCUMENTS

| | | | |
|---|---|---|---|
| 2,436,712 | 2/1948 | Burrell et al. | 174/77 |
| 3,128,139 | 4/1964 | Estes | 439/126 |
| 3,268,654 | 8/1966 | Morrison et al. | 174/138 |
| 3,995,929 | 12/1976 | Ghirardi et al. | 439/218 |
| 4,701,662 | 10/1987 | Yamanishi et al. | 313/51 |
| 4,810,198 | 3/1989 | Sturdevan | 439/125 |
| 4,906,202 | 3/1990 | Germ | 439/127 |
| 4,947,809 | 8/1990 | Hocking | 123/169 |
| 5,026,294 | 6/1991 | Hisatomi et al. | 439/125 |
| 5,144,936 | 9/1992 | Murata et al. | 439/125 |
| 5,178,550 | 1/1993 | Fusselman et al. | 439/125 |
| 5,179,327 | 1/1993 | Yagi et al. | 315/77 |

FOREIGN PATENT DOCUMENTS

| | | | |
|---|---|---|---|
| 445557 | 9/1991 | European Pat. Off. . | |
| 1204018 | 10/1965 | Germany | 439/125 |
| 2730084 | 1/1979 | Germany | 439/125 |
| 8580 | 1/1989 | Japan . | |
| 264776 | 11/1991 | Japan . | |
| 21175 | 3/1993 | Japan . | |

*Primary Examiner*—Gary F. Paumen

*Attorney, Agent, or Firm*—Jordan B. Bierman; Bierman and Muserlian

[57] ABSTRACT

There is disclosed a plug cap device (11) for an internal combustion engine wherein a bore (15) receiving a corrugation portion and a cylindrical portion of an insulator of a spark plug has a first portion (15*a*) corresponding to the corrugation portion and a second portion (15*b*) corresponding to the cylindrical portion such that the inner diameter (ϕP) of the first portion (15*a*) corresponding to the corrugation portion of the insulator is slightly smaller than the outer diameter of a major diameter portion of the corrugation portion and such that the inner diameter (ϕQ) of the second portion (15*b*) corresponding to the cylindrical portion of the insulator gradually decreases from the inner diameter (ϕP) of the first portion (15*a*) toward an insertion opening at which the spark plug is inserted to provide a tapered configuration, whereby the plug cap device (11) insures an improved electrical sealing property and provides high operating efficiency when fitted over and removed from the spark plug.

9 Claims, 3 Drawing Sheets

PLUG CAP DEVICE FOR INTERNAL COMBUSTION ENGINE

TITLE OF THE INVENTION

Plug Cap Device for Internal Combustion Engine

BACKGROUND OF THE INVENTION

1. Field of the Invention

The present invention relates to a plug cap device for an internal combustion engine for connection to a spark plug used in the internal combustion engine.

2. Description of the Prior Art

A plug cap device for carrying high voltage to a spark plug in an internal combustion engine has been of various constructions as disclosed in Japanese Utility Model Application Laid-Open No. 64-8580 (1989) and Japanese Patent Application Laid-Open No. 3-264776 (1991).

As shown in FIGS. 5 and 6, for example, a plug cap device 1 comprises a tubular plug cap body 2, an ignition cable 3 introduced into the plug cap body 2 at its one end, and an electric conductor 4 housed and held in the plug cap body 2 and connected to the ignition cable 3.

The plug cap body 2 is a flexible insulator formed of an elastic material such as silicone rubber.

The plug cap body 2 is press fitted at its second end over a spark plug 6 to connect a terminal portion of the spark plug 6 to the electric conductor 4.

In avoidance of leaks between the inner peripheral surface of the plug cap body 2 and the outer peripheral surface of an insulator 7 of the spark plug 6, the inner diameter of the plug cap body 2 receiving the insulator 7 of the spark plug 6 is smaller than the outer diameter of the insulator 7 so that the outer peripheral surface of the insulator 7 closely contacts the inner peripheral surface of the plug cap body 2 for exhibition of an electrical sealing property.

For example, when the outer diameter ϕD1 of a major diameter portion of a corrugation portion **7*a* of the insulator 7 is 10.2 mm and the outer diameter ϕD2 of a cylindrical portion 7*b* of the insulator 7 is 10.5 mm, the inner peripheral surface diameter ϕA of the plug cap body 2 receiving the spark plug 6 is 9.5 mm which is smaller than the outer diameter ϕD1 of the major diameter potion of the corrugation portion 7*a*. The inner diameter of the plug cap body 2 is of the same size or slightly increases gradually in a tapered configuration in a portion corresponding to the insertion position of the cylindrical portion 7*b* toward an insertion cud at which the spark plug 6 is relatively inserted into the plug cap body 2. The inner diameter ϕB of the plug cap body 2** at the insertion end is 9.9 min.

Recently, a need has arisen to improve the electrical sealing property with increasing voltage required for the spark plug 6.

For improvement in the electrical sealing property, the plug cap body 2 has been designed to have a smaller inner diameter ϕA to squeeze the insulator 7 of the spark plug 6 more tightly.

For example, when the outer diameter ϕD1 of the major diameter portion of the corrugation portion **7*a* of the insulator 7 is 10.2 mm and the outer diameter ϕD2 of the cylindrical portion 7*b* of the insulator 7 is 10.5 mm, the inner peripheral surface diameter ϕA of the plug cap body 2 receiving the spark plug 6 is 8.6 mm which is smaller than the outer diameter ϕD1 of the major diameter portion of the corrugation portion 7*a*. The inner diameter of the plug cap body 2 slightly increases gradually toward the insertion end in a tapered configuration in the portion corresponding to the insertion position of the cylindrical portion 7*b*. The inner diameter ϕB of the plug cap body 2** at the insertion end is 9.0 mm.

The corrugation portion **7*a* and cylindrical portion 7*b* of the insulator 7 are relatively inserted into the plug cap body 2 having the inner diameters ϕA and ϕB which are smaller than the outer diameters ϕD1 and ϕD2 of the insulator 7 of the spark plug 6. This provides the improved electrical sealing property but requires a greater force to insert the insulator 7 of the spark plug 6 into the plug cap body 2. In particular, when removed from the spark plug 6, the plug cap body 2 acts as a sucking-disc and an abnormally great force is required to remove the plug cap body 2 from the spark plug 6**, resulting in very low operating efficiency.

SUMMARY OF THE INVENTION

The present invention is intended for a plug cap device for an internal combustion engine. According to the present invention, the plug cap device comprises: a tubular plug cap body made of a flexible insulating material and having an opening, and a spark plug including a terminal portion and an insulator having a corrugation portion continuous with the terminal portion and a cylindrical portion continuous with the corrugation portion, wherein the terminal portion, the corrugation portion and the cylindrical portion are inserted in order into the opening of the plug cap body so that the outer peripheral surface of a major diameter portion of the corrugation portion and the outer peripheral surface of the cylindrical portion come in close contact with the inner peripheral surface of the opening of the plug cap body, the opening having a first portion corresponding to the insertion position of the corrugation portion and a second portion corresponding to the insertion position of the cylindrical portion, the inner diameter of the first portion of the opening being slightly smaller than the outer diameter of the major diameter portion of the corrugation portion, the inner diameter of the second portion of the opening gradually decreasing from the inner diameter of the first portion toward an insertion end at which the spark plug is inserted into the plug cap body to provide a tapered configuration.

Since the inner diameter of the opening of the plug cap body in the first portion corresponding to the insertion position of the corrugation portion of the insulator is slightly smaller than the outer diameter of the major diameter portion of the corrugation portion and the inner diameter of the opening of the plug cap body in the second portion corresponding to the insertion position of the cylindrical portion of the insulator decreases gradually toward the insertion end from the inner diameter of the first portion to provide the tapered configuration, the inner peripheral surface of the opening of the plug cap body reliably contacts the outer peripheral surface of the major diameter portion of the corrugation portion of the insulator and the outer peripheral surface of the cylindrical portion of the insulator, and the electrical sealing property is insured.

In particular, the inner diameter of the second portion of the opening of the plug cap body which decreases gradually toward the insertion end in the tapered configuration, ensures improved electrical sealing property in the second portion of the opening of the plug cap body, and meets the need for high voltage.

The improved electrical sealing property ensured in the second portion of the opening of the plug cap body permits the inner diameter of the first portion of the plug cap body to be larger and closer to the outer diameter of the major diameter portion of the corrugation portion. This reduces the insertion and removal resistances of the serrated corrugation portion when the plug cap body is fitted over and removed from the spark plug, providing high operating efficiency at that time.

According to another aspect of the present invention, the plug cap device comprises: a tubular plug cap body made of an insulating material and having a first opening, a tubular cap element made of a flexible insulating material and having a second opening, the cap element being fitted to a first end of the plug cap body so that the second opening is continuous with the first opening, and a spark plug including a terminal portion and an insulator having a corrugation portion continuous with the terminal portion and a cylindrical portion continuous with the corrugation portion, the terminal portion being inserted into the first opening through the second opening so that the outer peripheral surface of a major diameter portion of the corrugation portion and the outer peripheral surface of the cylindrical portion come in close contact with the inner peripheral surface of the second opening, the second opening having a first portion corresponding to the insertion position of the corrugation portion and a second portion corresponding to the insertion position of the cylindrical portion, the inner diameter of the first portion of the second opening being slightly smaller than the outer diameter of the major diameter portion of the corrugation portion, the inner diameter of the second portion of the second opening gradually decreasing from the inner diameter of the first portion toward an insertion end at which the spark plug is inserted into the plug cap body to provide a tapered configuration.

Since the inner diameter of the second opening of the cap element in the first portion corresponding to the insertion position of the corrugation portion of the insulator is slightly smaller than the outer diameter of the major diameter portion of the corrugation portion and the inner diameter of the second opening of the cap element in the second portion corresponding to the insertion position of the cylindrical portion of the insulator gradually decreases toward the insertion end from the inner diameter of the first portion to provide the tapered configuration, the inner peripheral surface of the second opening of the cap element reliably contacts the outer peripheral surface of the major diameter portion of the corrugation portion of the insulator and the outer peripheral surface of the cylindrical portion of the insulator, and the electrical sealing property is ensured.

In particular, the inner diameter of the second portion of the second opening of the cap element which decreases gradually toward the insertion end in the tapered configuration, ensures improved electrical sealing property in the second portion of the second opening of the cap element, and meets the need for high voltage.

The improved electrical sealing property ensured in the second potion of the second opening of the cap element permits the inner diameter of the first portion of the cap element to be larger and closer to the outer diameter of the major diameter portion of the corrugation portion. This reduces the insertion and removal resistances of the serrated corrugation portion when the plug cap body is fitted over and removed from the spark plug, providing high operating efficiency at that time.

An object of the present invention is to provide a plug cap device for an internal combustion engine which ensures an improved electrical sealing property and provides high operating efficiency when fitted over and removed from a spark plug.

These and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
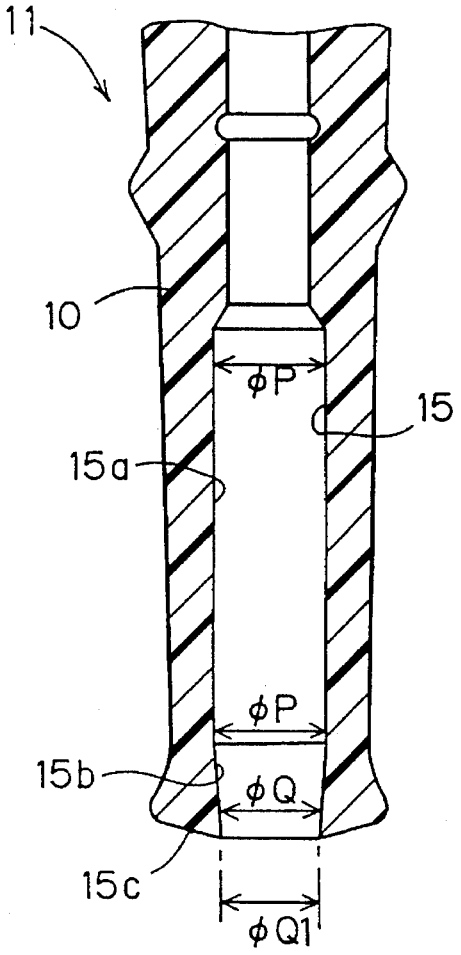
FIG. 1 is a sectional view of a principal part of a first preferred embodiment according to the present invention.
Figure 2:
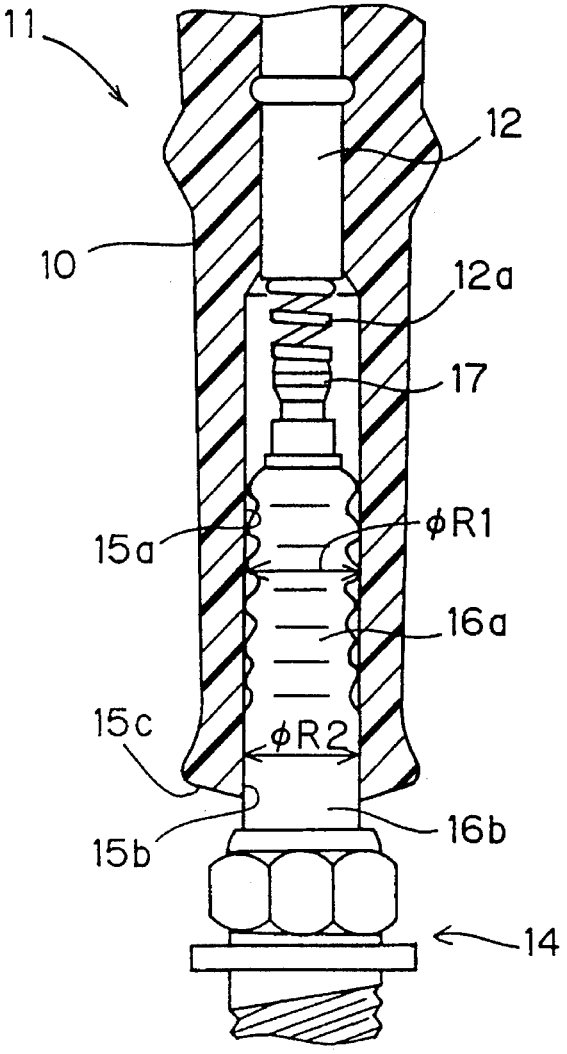
FIG. 2 is a sectional view of the principal part of the first preferred embodiment, with a spark plug fitted therein.

Referring to the drawings, a first preferred embodiment will now be described according to the present invention. As shown in FIGS. 1 and 2, a plug cap body 10 of a plug cap device 11 for an internal combustion engine of independent ignition type is a tubular flexible insulator made of an elastic material such as silicone rubber.

An electric conductor 12 is housed and held in the plug cap body 10 in the same manner as the prior art. A spark plug 14 includes a terminal portion 17, and an insulator 16 having a corrugation portion **16*a* continuous with the terminal portion 17 and a cylindrical portion 16*b* continuous with the corrugation portion 16*a***.

The plug cap body 10 includes an opening 15 receiving the spark plug 14 and having an inner peripheral surface including a first portion **15*a* corresponding to the insertion position of the corrugation portion 16*a* of the insulator 16 of the spark plug 14 and a second portion 15*b* corresponding to the insertion position of the cylindrical portion 16*b* of the insulator 16 of the spark plug 14**.

The inner diameter $\phi P$ of the first portion **15*a* of the opening 15 corresponding to the insertion position of the corrugation portion 16*a* is slightly smaller than the outer diameter $\phi R1$ of a major diameter portion of the corrugation portion 16*a* and is of the same size in the direction of relative insertion of the spark plug 14. The inner diameter $\phi Q$ of the second portion 15*b* of the opening 15 corresponding to the insertion position of the cylindrical portion 16*b* slightly decreases gradually toward an insertion end at which the spark plug 14 is relatively inserted into the plug cap body 10 from the inner diameter $\phi P$ of the first portion 15*a*** to provide a tapered configuration.

The inner peripheral surface diameter $\phi P$ of the first portion **15*a* of the plug cap body 10 corresponding to the insertion position of the corrugation portion 16*a* is $\phi R1\times 0.85$ to $\phi R1\times 0.95$ mm where $\phi R1$ is the outer diameter of the major diameter portion of the corrugation portion 16*a* of the insulator 16. The inner diameter $\phi Q1$ of the second portion 15*b* corresponding to the insertion position of the cylindrical portion 16*b* at the insertion end is $\phi R2\times 0.80$ to $\phi R2\times 0.90$ mm where ϕR2 is the outer diameter of the cylindrical potion 16***b* of the insulator 16. More specifically, when the outer diameter ϕR1 of the major diameter portion of the corrugation portion 16*a* of the insulator 16 is 10.2 mm and the outer diameter ϕR2 of the cylindrical portion 16*b* of the insulator 16 is 10.5 mm, the inner peripheral surface diameter ϕP of the first potion 15*a* of the plug cap body 10 corresponding to the insertion position of the corrugation portion 16*a* is 9.5 mm which is slightly smaller than the outer diameter ϕR1 of the major diameter portion of the corrugation portion 16*a*. The inner diameter ϕQ1 of the second portion 15*b* corresponding to the insertion position of the cylindrical portion 16*b* at the insertion end is 8.6 mm.

An end surface 15*c* at the insertion end of the opening 15 of the plug cap body 10 has a diameter gradually increasing in the direction of the relative insertion of the spark plug 14 to provide a tapered configuration.

In the first preferred embodiment as above constructed, the terminal portion 17, corrugation portion 16*a*, and cylindrical portion 16*b* of the spark plug 14 are inserted in order into the opening 15 of the plug cap body 10 and press fitted therein, as shown in FIG. 2. The terminal portion 17 is then connected to a spring portion 12*a* of the electric conductor 12.

At this time, the plug cap body 10 is elastically deformed so that the inner peripheral surface of the first portion 15*a* corresponding to the insertion position of the corrugation portion 16*a* comes in close contact with the outer peripheral surface of the major diameter portion of the corrugation portion 16*a* and the inner peripheral surface of the second portion 15*b* corresponding to the insertion position of the cylindrical portion 16*b* comes in close contact with the outer peripheral surface of the cylindrical portion 16*b*. This prevents leaks from the surface of the insulator 16 of the spark plug 14, insuring the electrical sealing property.

In particular, since the inner diameter ϕQ of the second portion 15*b* of the plug cap body 10 corresponding to the insertion position of the cylindrical portion 16*b* gradually decreases toward the insertion end in the tapered configuration, the plug cap device 11 ensures improved electrical sealing property in the second portion 15*b* of the plug cap body 10 corresponding to the insertion position of the cylindrical portion 16*b*, and meets the need for high voltage.

The improved electrical sealing property ensured in the second portion 15*b* of the plug cap body 10 corresponding to the insertion position of the cylindrical portion 16*b* enables the inner diameter ϕP (9.5 mm) of the first portion 15*a* of the plug cap body 10 corresponding to the insertion position of the corrugation portion 16*a* to be larger and closer to the outer diameter ϕR1 (10.2 mm) of the major diameter portion of the corrugation portion 16*a* than the prior art inner diameter ϕA (8.6 mm). Thus, the insertion resistance and removal resistance of the serrated corrugation portion 16*a* are reduced when the plug cap body 10 is fitted over and removed from the spark plug 14, providing high operating efficiency at that time.

Furthermore, since the end surface 15*c* at the insertion end of the opening 15 of the plug cap body 10 is chambered so that the diameter increases gradually in the tapered configuration, the wall thickness of the plug cap body 10 gradually decreases toward the insertion end. Such construction permits loads to gradually increases as the plug cap body 10 is fitted over the insulator 16 of the spark plug 14, providing an improved feeling during insertion and removal. If a general standard of electrical sealing property is required, the inner diameters ϕP and ϕQ of the opening 15 of the plug cap body 10 may be larger to reduce the insertion and removal resistances.

Figure 3:
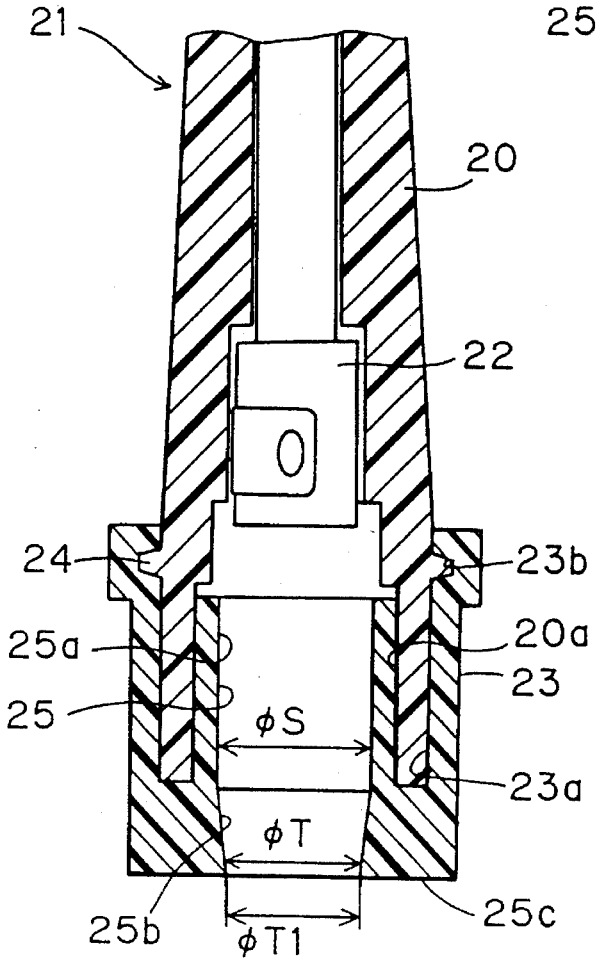
FIG. 3 is a sectional view of a principal part of a second preferred embodiment according to the present invention.
Figure 5:
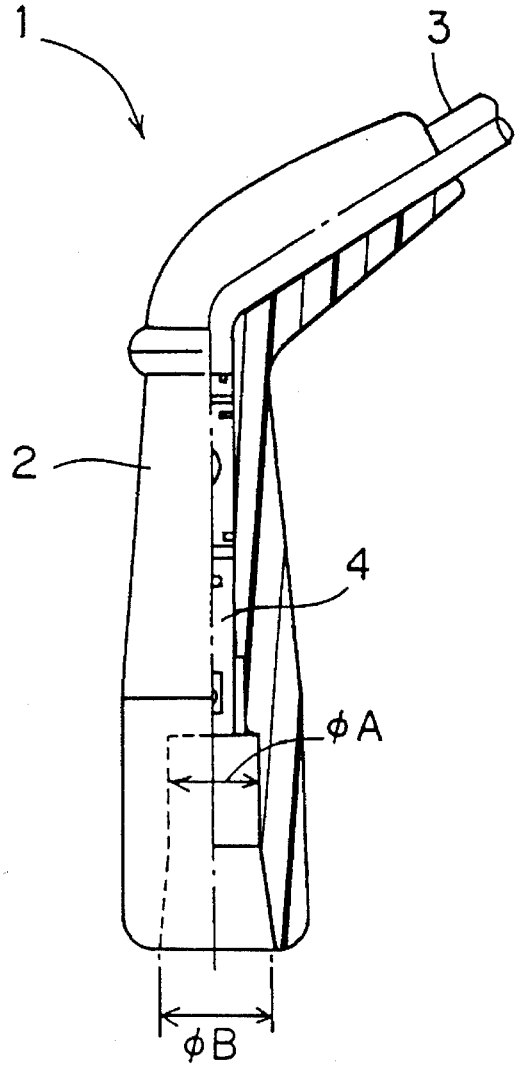
FIG. 5 PRIOR ART
FIG. 5 is a sectional view of a principal part of the prior art.
Figure 6:
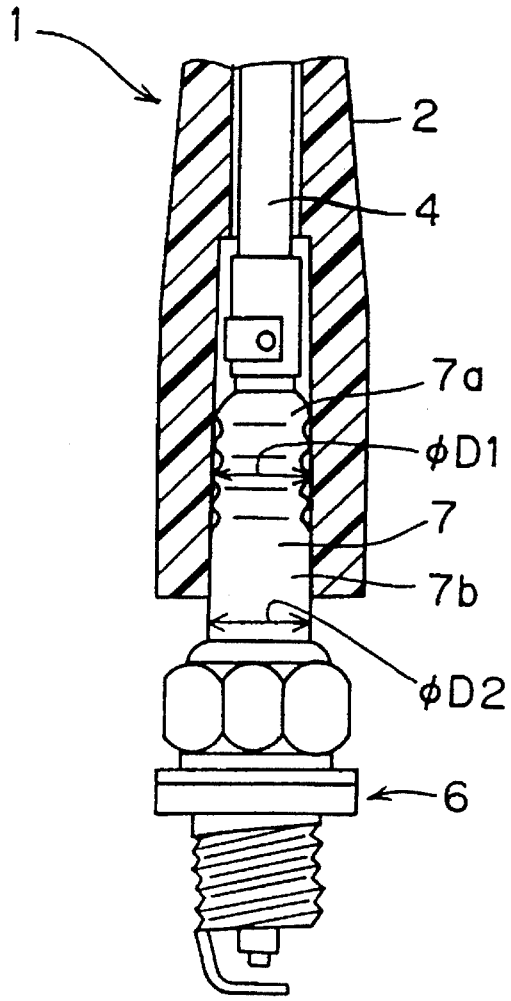
FIG. 6 PRIOR ART
FIG. 6 is a sectional view of the principal part of the prior art, with a spark plug fitted therein.

Referring to the drawings, a second preferred embodiment will now be discussed according to the present invention. As shown in FIG. 3, a plug cap body 20 of a plug cap device 21 for an internal combustion engine is of tubular configuration and made of an insulative thermosetting resin or the like.

In the same manner as the prior art, an electric conductor 22 is housed and held in the plug cap body 20, and an ignition cable (not shown) introduced into the plug cap body 20 at its first end is connected to the electric conductor 22.

The plug cap body 20 includes a first opening 20*a* at its second end, and a tubular cap element 23 which is a flexible insulator made of an elastic material such as silicone rubber is fitted to the second end of the plug cap body 20. A circumferential annular groove 23*a* is formed in a first end surface of the cap element 23, and the second end of the plug cap body 20 is fitted in the groove 23*a*. At this time, a circumferential ledge 24 formed on the outer peripheral surface of the plug cap body 20 at its end engages an groove 23*b* of the cap element 23, which is held and prevented from withdrawal from the plug cap body 20. The first opening 20*a* of the plug cap body 20 is continuous with a second opening 25 of the cap element 23.

The inner peripheral surface of the second opening 25 of the cap element 23 receiving the spark plug 14 includes a first portion 25*a* corresponding to the insertion position of the corrugation portion 16*a* of the insulator 16 of the spark plug 14 and a second portion 25*b* corresponding to the insertion position of the cylindrical portion 16*b* of the insulator 16 of the spark plug 14.

The inner diameter ϕS of the first portion 25*a* of the second opening 25 corresponding to the insertion position of the corrugation portion 16*a* is slightly smaller than the outer diameter ϕR1 of the major diameter portion of the corrugation portion 16*a* and is of the same size in the direction of relative insertion of the spark plug 14. The inner diameter ϕT of the second portion 25*b* of the second opening 25 corresponding to the insertion position of the cylindrical portion 16*b* decreases gradually toward the insertion end at which the spark plug 14 is relatively inserted into the plug cap body 20 from the inner diameter ϕS of the first portion 25*a* to provide a tapered configuration.

For example, the inner peripheral surface diameter ϕS of the first portion 25*a* of the cap element 23 corresponding to the insertion position of the corrugation portion 16*a* is ϕR1×0.85 to ϕR1×0.95 mm where ϕR1 is the outer diameter of the major diameter portion of the corrugation portion 16*a* of the insulator 16 (for example, 10.2 mm). The inner diameter ϕT1 of the second portion 25*b* corresponding to the insertion position of the cylindrical portion 16*b* at the insertion end is ϕR2×0.80 to ϕR2×0.90 mm where ϕR2 is the outer diameter of the cylindrical portion 16*b* of the insulator 16 (for example, 10.5 mm).

In the second preferred embodiment as above constructed, when the plug cap body 20 is fitted over the spark plug 14 in substantially the same manner as the first preferred embodiment, the terminal portion 17 of the spark plug 14 is inserted into the first opening 20*a* through the second opening 25 and is then connected to the electric conductor 22. At this time, the cap element 23 is elastically deformed so that the inner peripheral surface of the first portion 25*a* corresponding to the insertion position of the corrugation portion 16*a* comes in close contact with the outer peripheral surface of the major diameter portion of the corrugation portion 16*a* and the inner peripheral surface of the second portion 25*b* corresponding to the insertion position of the cylindrical portion 16*b* comes in close contact with the outer peripheral surface of the cylindrical portion 16*b*. This prevents leaks from the surface of the insulator 16 of the spark plug 14, ensuring the electrical sealing property.

In particular, since the inner diameter ϕT of the second portion 25*b* of the cap element 23 corresponding to the insertion position of the cylindrical portion 16*b* decreases gradually toward the insertion end in the tapered configuration, the plug cap device 21 ensures improved electrical sealing property in the second portion 25*b* of the cap element 23 corresponding to the insertion position of the cylindrical portion 16*b*, and meets the need for high voltage.

The improved electrical sealing property ensured in the second portion 25*b* of the cap element 23 corresponding to the insertion position of the cylindrical portion 16*b* enables the inner diameter ϕS of the first portion 25*a* of the cap element 23 corresponding to the insertion position of the corrugation portion 16*a* to be larger and closer to the outer diameter ϕR1 (10.2 mm) of the major diameter portion of the corrugation portion 16*a* than the prior art inner diameter ϕA (8.6 mm). Thus, the insertion resistance and removal resistance of the serrated corrugation portion 16*a* are reduced when the plug cap body 20 is fitted over and removed from the spark plug 14, providing high operating efficiency at that time.

Figure 4:
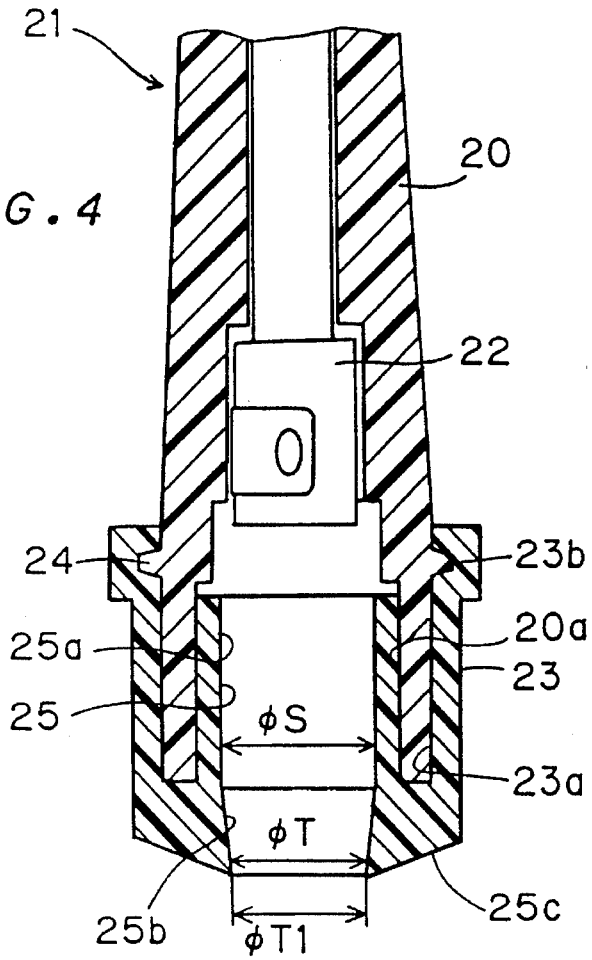
FIG. 4 is a sectional view of a principal part of a modification of the second preferred embodiment.

As shown in FIG. 4, an end surface 25*c* at the insertion end of the second opening 25 of the cap element 23 may have a diameter gradually increasing in the direction of the relative insertion of the spark plug 14 to provide a tapered configuration in the same manner as the first preferred embodiment. If a general standard of electrical sealing property is required, the inner diameters ϕS and ϕT of the second opening 25 of the cap element 23 may be larger to reduce the insertion and removal resistances. () The present invention is not limited to the plug cap devices 11 and 21 of ignition type of the first and second preferred embodiments but may be applied to any types of plug cap devices.

While the invention has been shown and described in detail, the foregoing description is in all aspects illustrative and not restrictive. It is therefore understood that numerous modifications and variations can be devised without departing from the scope of the invention.

What is claimed is:

1. A plug cap device for an internal combustion engine, comprising:

a tubular plug cap body made of a flexible insulating material and having a bore, and a spark plug including a terminal portion and an insulator with a corrugation portion continuous with said terminal portion and a cylindrical portion continuous with said corrugation portion, wherein said terminal portion, said corrugation portion, and said cylindrical portion are inserted into said bore so that an outer peripheral surface of a major diameter portion of said corrugation portion and an outer peripheral surface of said cylindrical portion come in close contact with an inner peripheral surface of said bore, said bore having a first portion complementary to said corrugation portion and a second portion complementary to said cylindrical portion, an inner diameter of said first portion being slightly smaller than an outer diameter of said major diameter portion prior to insertion of said spark plug, and an inner diameter of said second portion, prior to insertion of said spark plug, tapering from said first portion to an insertion end opening at which said spark plug is inserted into said plug cap body to provide a tapered configuration of said second portion.

2. The plug cap device of claim 1 in which $\phi P=0.85\ \phi R_1$ to $0.95\ \phi R_1$ and $\phi Q=0.80\ \phi R_2$ to $0.90\ \phi R_2$ wherein ϕP is said inner diameter of said first portion, $\phi R_1$ is said outer diameter of said major diameter portion, $\phi Q_1$ is said inner diameter of said second portion at said insertion end, and $\phi R_2$ is said outer diameter of said cylindrical portion.

3. The plug cap device of claim 2, wherein said lug cap body has an end surface at said insertion end of said opening, and said end surface has a diameter gradually increasing in the direction of insertion of said spark plug to provide a tapered configuration.

4. The plug cap device of claim 1, wherein said plug cap body is made of silicone rubber.

5. The plug cap device of claim 1 wherein a maximum outer diameter of said second portion is greater than a maximum outer diameter of said first portion.

6. The plug cap of claim 1 wherein the entire said outer peripheral surface of said major diameter portion is adapted to be in close contact with said inner peripheral surface of said bore.

7. A plug cap device for an internal combustion engine, comprising:

a tubular plug cap body made of an insulating material and having a first bore,

A tubular cap element made of a flexible insulating material and having a second bore, said cap element being fitted to a first end of said plug cap body so that said second bore is continuous with said first bore, and a spark plug including a terminal portion and an insulator having a corrugation portion continuous with said terminal portion and a cylindrical portion continuous with said corrugation portion, said terminal portion being inserted into said first bore through said second bore so that an outer peripheral surface of a major diameter portion of said corrugation portion and an outer peripheral surface of said cylindrical portion come in close contact with an inner peripheral surface of said second bore, said second bore having a first portion complementary to said corrugation portion and a second portion complementary to said cylindrical portion, an inner diameter of said first portion of said second bore being slightly smaller than an outer diameter of the major diameter portion prior to insertion of said spark plug, and an inner diameter of said second portion of said second bore, prior to insertion of said spark plug, tapering from said first portion toward an insertion opening at which said spark plug is inserted into said cap element to provide a tapered configuration.

8. The plug cap device of claim 7, wherein said cap element has an outer end surface at said insertion opening, and said end surface has a diameter gradually increasing in the direction of insertion of said spark plug to provide a tapered configuration.

9. The plug cap device of claim 7, wherein said plug cap body is made of a thermosetting resin, and said cap element is made of silicone rubber.

* * * * *